United States Patent [19]

Endres et al.

[11] 4,380,403

[45] Apr. 19, 1983

[54] CLOSURE CAP FOR A WRITING INSTRUMENT

[75] Inventors: Bernhard Endres, Winkelhaid; Klaus Glombitza, Nuremberg, both of Fed. Rep. of Germany

[73] Assignee: J. S. Staedtler K.G., Nurnburg, Fed. Rep. of Germany

[21] Appl. No.: 224,930

[22] Filed: Jan. 14, 1981

[30] Foreign Application Priority Data

Jan. 19, 1980 [DE] Fed. Rep. of Germany ..... 8001322

[51] Int. Cl.[3] ..... B43K 9/00

[52] U.S. Cl. ..... 401/213; 401/202; 401/243; 401/246; 401/247

[58] Field of Search ..... 401/213, 243, 244, 245, 401/246, 247, 98, 202, 262, 258

[56] References Cited

U.S. PATENT DOCUMENTS

| | | | |
|---|---|---|---|
| 1,075,631 | 10/1913 | Dods | 401/246 |
| 2,396,771 | 3/1946 | Brinson, Sr. | 401/244 |
| 3,502,417 | 3/1970 | Hartmann | 401/202 |
| 3,802,788 | 4/1974 | Danjczek | 401/258 X |

FOREIGN PATENT DOCUMENTS

| | | | |
|---|---|---|---|
| 827760 | 1/1952 | Fed. Rep. of Germany | 401/246 |
| 945818 | 7/1956 | Fed. Rep. of Germany | 401/246 |
| 1915566 | 10/1970 | Fed. Rep. of Germany | 401/202 |
| 7031175 | 11/1970 | Fed. Rep. of Germany | 401/247 |
| 2509978 | 9/1976 | Fed. Rep. of Germany | 401/202 |
| 321717 | 5/1957 | Switzerland | 401/213 |
| 362420 | 5/1930 | United Kingdom | 401/246 |

*Primary Examiner*—Steven A. Bratlie

*Attorney, Agent, or Firm*—Edmund M. Jaskiewicz

[57] ABSTRACT

A closure cap for a writing instrument such as a ink pen and the like has an outer generally cylindrical cap housing within which is a sealing sleeve having a closed end to close one end of the cap housing. A slide sleeve of a hard rigid material is retained against axial movement within the sealing sleeve. A closure member of a soft resilient durable material is axially slideable within the slide sleeve and is acted upon by spring means which may include a helical spring or axially extending resilient strips.

9 Claims, 3 Drawing Figures

CLOSURE CAP FOR A WRITING INSTRUMENT

The present invention relates to a closure cap for writing instruments, more particularly, to such a closure cap which has multiple sealing elements.

In the known structures of closure caps, particularly those intended for tubular writing instruments, there is a problem of achieving a balance or relationship of the tolerances which provides proper sealing between the sealing elements and, at the same time, if the sealing elements are axially displaceable with each other, to provide that these sealing elements are slideable with respect to each other with sufficient ease while at the same time fulfilling the sealing function. Further, the known forms of closure caps have also the disadvantage that a single sealing element in the closure cap is very difficult to install or mount in production and can only be installed in a particular direction with respect to the closure cap.

In DE-GM 70 31 175 there is disclosed a closure cap for tubular writing instruments which comprises a housing and two sealing elements one of which is axially displaceable with respect to each other under the force of a spring. The inner sealing element which is constructed as a closure member should be constructed of a rigid, non-elastic material. It is proposed that this closure member can be made of polyethylene, polypropylene, polystyrene or also of metal, such as a light-weight metal. When the closure member is made of either of the abovementioned plastic materials or metals, it is possible to bridge the relatively great range of tolerances between the different zones of the writing instruments which are to be sealed from each other. However, a complete sealing on all sides, in particular of the support zone of the tube, cannot be assured because the material of the closure member is not sufficiently elastically deformable so as to fit closely around the zones of the writing instrument which are to be sealed.

In DE-GM 69 32 624 there was then proposed to employ inside a closure cap an axially moveable spring-loaded closure member constructed of a soft material. In this construction the closure member is not disposed within a completely closed additional sealing element and it is thus necessary to construct the housing itself from a high-grade, expensive material which is impenetrable by water vapors or to employ a separate additional seal. There is thus provided a sealing ring to define a second closure zone and this ring is positioned around the writing instrument after the instrument has been inserted into a receptacle of the housing. It is apparent that in addition to the abovementioned disadvantages this closure cap cannot be constructed as a unit before being installed since both of the sealing members do not communicate directly with each other but are mounted and function separately from each other.

It is therefore the principal object of the present invention to provide a novel and improved closure cap for writing instruments.

It is another object of the present invention to provide such a closure cap which is easily operable and provides dependable sealing at all possible entry points of air for a long period of time without the necessity for depending upon close tolerances in axial distances between the sealing surfaces.

It is a further object of the present invention to provide such a closure cap which is easy to install and assemble, inexpensive to manufacture even if it is constructed from a number of individual components.

According to the present invention a closure cap for writing instruments may comprise an outer cap housing within which is a sealing sleeve. A slide sleeve of a hard rigid material is retained against axial movement within the sealing sleeve. A closure member of a soft, resilient, durable material is axially displaceable within the slide sleeve and is acted upon by a spring within the slide sleeve.

By using two sealing elements each constructed of a soft, durable resilient material and disposing these sealing elements one within the other, and also by utilizing a spring for the axial sliding displacement of a sealing element within the housing, it is possible, according to the present invention, to readily and dependably seal all possible air entry points to the writing instruments for a long period of time. In order to achieve a completely air-tight structure it is only necessary to construct the outer sealing element or sealing sleeve so as to be impenetrable by water vapors and of a material which is relatively soft and elastic such as polyethylene. The inner sealing element or closure member is preferable made of a polyvinylchloride (soft PVC), silicon or polyurethane elastomer and has approximately 68–85 Shore (DIN 53505). In addition, the closure member may be made of a closed-pore foam material so as to be even lighter in weight and more resilient in nature.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
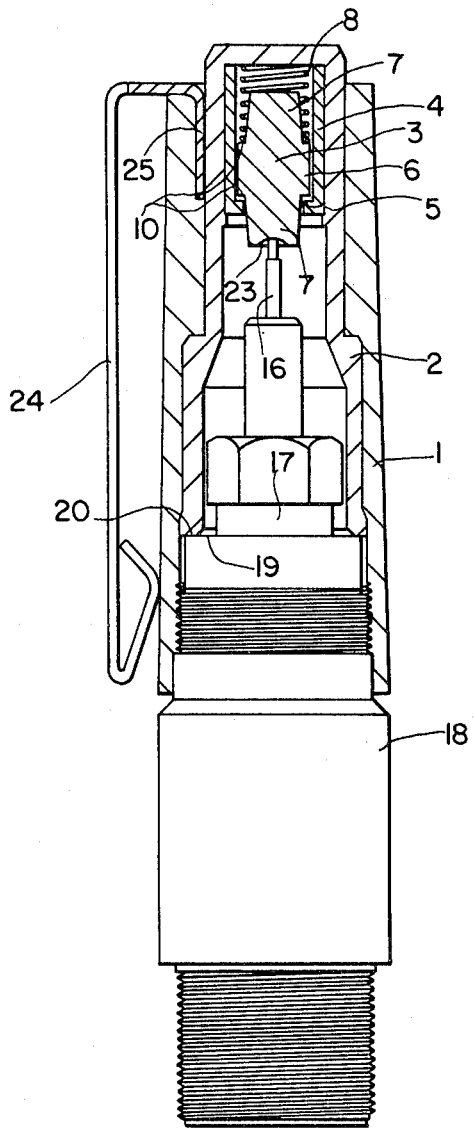
FIG. 1 is an axial sectional view of a closure cap according to the present invention showing the closure cap positioned on the end of a writing instrument.

In FIG. 1 the closure cap according to the present invention comprises a generally cylindrical cap housing 1 into one end of which is received a tubular writing instrument 18 which may be an ink pen. On the front end or tip portion of the tubular pen there is provided a writing assembly 17 from which extends axially a writing tube or tip 16. A sealing sleeve 2 which has a closed end is press-fitted within the cap housing 1 so as to close off one end of the housing. A slide sleeve 4 is mounted within the sealing sleeve 2 at one end thereof and is held against axial movement by an internal annular shoulder bearing against the lower end of the sleeve 4 as seen in FIG. 1. A closure member 3 is axially displaceable within the slide sleeve 4 and is acted upon by a spring 8 so as to be forced in a direction toward an internal flange 5 on the lower end of the slide sleeve 4.

The closure member 3 which is made of a soft, resilient, durable material comprises a central band or collar 6 and a pair of pins 7 axially extending from both sides of the collar 6. The outer diameter of the collar 6 is shaped and dimensioned so as to slide closely within the interior of the slide sleeve 4. The diameter of the pins 7 is less than the diameter of the collar 6 so that annular shoulders 10 are formed at the intersections of the pins 7 with the collar 6. The spring 8 bears against one of the shoulders 10 and the other shoulder 10 is engageable with the internal flange 5 which functions as a stop to limit the axial displacement of the closure member in a downward direction as viewed in FIG. 1.

The front or lower surface 23 of the closure member 3 is provided with a hollow or recess which receives the writing tip 16. Because of the soft and resilient properties of the closure member 3 the front surface 23 will be easily deformed when the tip of the writing tube is inserted therein and will thus close off the face side of the writing tube from the atmosphere.

Independently of this sealing of the tip 16 by the front surface 23 of the closure member, the closure member 3 will be displaced axially against the force of the spring 8 until a front surface 19 of the tubular pen also abuts against a stop edge 20 of the sealing sleeve 2. This seal between surface 19 and stop edge 20 also completely closes off this portion of the closure cap from the atmosphere.

The closure cap may be provided with a resilient clip 24 as known in the art and which may be mounted in place by means of a bracket 25 pressed against the interior of the cap housing. This connection is advantageously reinforced and strengthened by the rigid slide sleeve 4.

In this arrangement of the outer sealing element consisting of the sealing sleeve and the inner sealing element consisting of the elastic closure member, is also advantageous to readily position a slide jacket of relatively hard rigid material between these two components. The slide sleeve is preferably of polypropylene or a similar material and not of polystyrene since sticking or other binding must be avoided when, for example, PVC is used for one of the sealing elements. The cap housing 1 itself may be made of polystyrene or a similar relatively stiff material which is penetrable by water vapors if the sealing sleeve does not constitute the housing in the construction.

Figure 2:
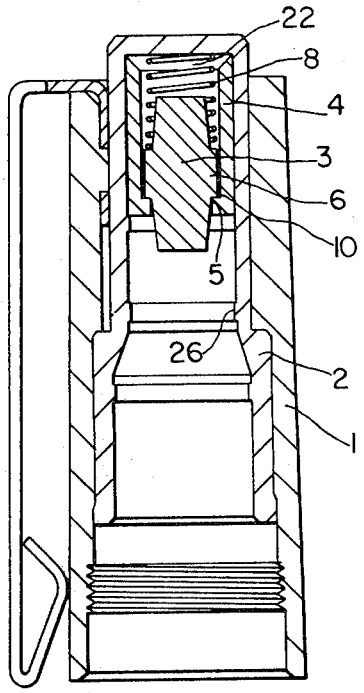
FIG. 2 is a view similar to that of FIG. 1 but illustrating the closure cap per se.

In FIG. 2, there is shown a closure cap according to the present invention per se without the writing instrument disposed therein. Since no writing instrument is inserted into the closure cap, the stop surface 10 of the collar 6 abuts against the annular stop 5 of the slide sleeve 4. The collar 6 thus functions as the essential guide element for the closure member 3. The slide sleeve may be press-fitted within the sealing sleeve 2 and retained in position by means of an internal rib or roll 26 formed around the inner surface of the sealing sleeve 2.

A helical compression spring 8 functions as a spring element but this can be replaced by a plurality of axially extending spring strips or lamellas 21 mounted within the bottom 22 of the sealing sleeve 2. The strips are radially deformable under axial pressure.

Figure 3:
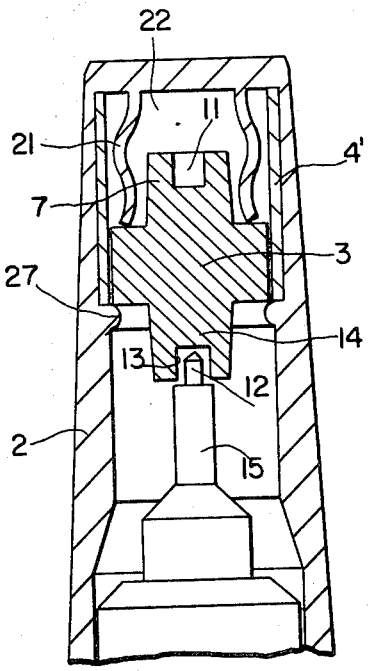
FIG. 3 is a view similar to that of FIG. 1 and showing a modification of the closure cap.

In FIG. 3 there is disclosed a modification of the present invention wherein the closure member 3 is received directly within the sealing sleeve 2. However, a slide sleeve 4' may be employed as shown. The axially symmetrically disposed pins 7 of the closure member 3 are each provided in their ends with an axial recess or bore 11 into one of which is received the writing tip 12 and in the other of which may be received a smaller diameter helical spring or a spring strip 21. A plurality of the spring strips 21 may be disposed so that their ends bear against a shoulder 10 on the closure member 3 and the spring strips are resilient and deformable in an axial direction so as to provide a spring force urging the closure member 3 downwardly as viewed in FIG. 3.

In order to avoid damage to very sensitive writing tips such as the fine points of fountain pens or other writing structures, the recess 11 is preferably dimensioned and shaped so that a writing tip does not contact its inner wall 13 or end wall 14 upon being received within the recess 11. The axial movement to achieve proper insertion of the writing tip 12 into a recess of the closure member is achieved by means of a protective jacket 15 as known in the art and used for sensitive fiber writing tips or by the front end portion of the shaft of the writing instrument itself.

In the modification of FIG. 3 it is possible to dispense with a separate cap housing and to modify the sealing sleeve 2 such that this sealing sleeve can be sealingly engaged upon the tubular shaft 28 of the writing instrument. No additional slide sleeve is thus utilized. The stop for axially limiting the displacement of the closure member 3 under the action of a spring is defined by a stop rib 27 which is formed directly on the sealing sleeve 2 or may be inserted into the sealing sleeve into, for example, an annular groove.

The use of spring strips or lamellas 21 as described above results in an inexpensive closure cap which consists of only two separate components but still provides optimum protection against evaporation and a proper and effective axial tolerance of all of the different zones or portions of the closure cap which are to be sealed.

It will be understood that this invention is susceptible to modification in order to adapt it to different usages and conditions and, accordingly, it is desired to comprehend such modifications within this invention as may fall within the scope of the appended claims.

What is claimed is:

1. A closure cap for a writing instrument comprising an outer cap housing, a sealing sleeve of a soft resilient durable material fitted within said cap housing, a tubular open ended slide sleeve of hard rigid material retained against axial movement within said sealing sleeve, a closure member of a soft resilient durable material confined within and axially displaceable within said slide sleeve and having an end engageable with a tip of a writing instrument inserted into said cap housing, said slide sleeve disposed between said sealing sleeve and said closure member, and spring means within said slide sleeve having one end abutting said sealing sleeve and another acting against said closure member toward said tip.

2. A closure cap as claimed in claim 1 wherein said cap housing is generally cylindrical and said sealing sleeve has a closed end to close one end of said cap housing.

3. A closure cap as claimed in claim 1 wherein there is a stop within said slide sleeve against which said closure member is urged by said spring means.

4. A closure cap as claimed in claim 3 wherein said stop comprises an internal annular flange.

5. A closure cap as claimed in claim 1 wherein said closure member comprises a central annular band portion and a pair of pins each having a diameter less than that of said band portion and extending axially in opposite directions from said band portion.

6. A closure cap as claimed in claim 5 wherein each of said pins has the same size and shape, said spring means comprising a helical spring, the maximum diameter of said pins being less than the inner diameter of said helical spring.

7. A closure cap as claimed in claim 6 wherein the shape of said band portion conforms to the inner cylindrical surface of said slide sleeve such that said closure member is axially slideable therein, there being a pair of annular shoulders and each disposed between said band portion and a pin, said spring being supported on one of said shoulders and the other of said shoulders being engageable with an internal flange on said slide sleeve to limit axial movement of said closure.

8. A closure cap as claimed in claim 5 wherein there is an axial recess in the end of each of said pins, each recess being shaped to receive a tip of a writing instrument such that the tip is spaced from the end and side walls of the recess.

9. A closure cap as claimed in claim 1 wherein said spring means comprises a plurality of spring strips extending axially from the inner surface of a closed end of said sealing sleeve, the spring force of said strips being directed axially.

* * * * *